US011670871B2

(12) United States Patent
Lim et al.

(10) Patent No.: US 11,670,871 B2
(45) Date of Patent: Jun. 6, 2023

(54) ARRAY ANTENNA INCLUDING MULTIPLE POLARIZATION PORTS AND ELECTRONIC DEVICE INCLUDING SAME

(71) Applicants: Hongik University Industry—Academia Cooperation Foundation, Seoul (KR); Kookmin University Industry Academy Cooperation Foundation, Seoul (KR)

(72) Inventors: Tae Heung Lim, Seoul (KR); Byung-Jun Jang, Seoul (KR); Hosung Choo, Seoul (KR)

(73) Assignees: Hongik University Iudustry—Academia Cooperation Foundation, Seoul (KR); Kookmin University industry Academy Cooperation Foundation, Seoul (KR)

( * ) Notice: Subject to any disclaimer, the term of this patent is extended or adjusted under 35 U.S.C. 154(b) by 0 days.

(21) Appl. No.: 17/466,709

(22) Filed: Sep. 3, 2021

(65) Prior Publication Data

US 2023/0057434 A1 Feb. 23, 2023

(30) Foreign Application Priority Data

Aug. 17, 2021 (KR) ..... 10-2021-0108236

(51) Int. Cl.
*H01Q 21/06* (2006.01)
*H01Q 9/04* (2006.01)

(52) U.S. Cl.
CPC ..... *H01Q 21/065* (2013.01); *H01Q 9/0435* (2013.01)

(58) Field of Classification Search
CPC .... H01Q 21/065; H01Q 9/0435; H01Q 1/243; H01Q 21/00
See application file for complete search history.

(56) References Cited

U.S. PATENT DOCUMENTS 5,006,859 A * 4/1991 Wong ..... H01Q 9/0457 343/700 MS
7,595,766 B2 * 9/2009 Rofougaran ..... H01Q 1/24 343/820
7,609,221 B2 10/2009 Chung et al.
(Continued)

FOREIGN PATENT DOCUMENTS

KR 10-2009-0021662 A 3/2009
KR 10-2009-0047054 A 5/2009
(Continued)

OTHER PUBLICATIONS

Korean Office Action dated Sep. 19, 2022, issued in Korean Patent Application No. 10-2021-0108236.

*Primary Examiner* — David E Lotter
(74) *Attorney, Agent, or Firm* — Jefferson IP Law, LLP

(57) ABSTRACT

An array antenna is proved. The array antenna provides multi-polarization by arranging multiple ports at adjacent positions. Specifically, the array antenna includes a first substrate having a first thickness and a rectangular shape, a second substrate disposed to be in contact with the bottom surface of the first substrate and having a second thickness and a rectangular shape, a ground surface shared by the first substrate and the second substrate, and first ports and second ports disposed to penetrate the ground surface.

16 Claims, 7 Drawing Sheets

(56) References Cited

U.S. PATENT DOCUMENTS

| | | | | |
|---|---|---|---|---|
| 10,581,169 | B2 | 3/2020 | Kim et al. | |
| 2008/0030422 | A1* | 2/2008 | Gevargiz | H01Q 3/26 343/860 |
| 2010/0253585 | A1* | 10/2010 | Llorens del Rio | H01Q 1/3275 343/756 |
| 2014/0062824 | A1* | 3/2014 | Yamaguchi | H01Q 9/045 343/834 |
| 2020/0212569 | A1* | 7/2020 | Kumar | H01Q 21/065 |
| 2020/0220270 | A1* | 7/2020 | Onaka | H01Q 1/2208 |
| 2021/0044025 | A1* | 2/2021 | Etani | H01Q 1/38 |
| 2021/0296773 | A1* | 9/2021 | Baniya | H05K 1/0243 |

FOREIGN PATENT DOCUMENTS

| | | | |
|---|---|---|---|
| KR | 10-2011-0005917 | A | 1/2011 |
| KR | 10-2014-0134452 | A | 11/2014 |
| KR | 10-1891562 | B1 | 8/2018 |
| KR | 10-2019-0022074 | A | 3/2019 |
| KR | 10-2080305 | B1 | 2/2020 |

* cited by examiner

| Parameters | Values |
|---|---|
| $w_1$ (Radiating patch outer width) | 19.5 mm ~ 20.5 mm |
| $w_2$ (Radiating patch inner width) | 0.5 mm ~ 2.2 mm |
| Patch material | Copper (conductivity = $5.8 \times 10^7$) |
| $r_1$ (Feeding patch inner radius) | 0.5 mm ~ 2 mm |
| $r_2$ (Feeding patch outer radius) | 7 mm ~ 8 mm |
| $h_1$ (Feeding patch substrate height) | 3.5 mm ~ 4.5 mm |
| $h_2$ (Radiating patch substrate height) | 3.5 mm ~ 4.5 mm |
| High dielectric ceramic substrate | Ceramic (er = 20, loss tangent 0.0023) |
| g | > 80 mm |
| $l_1$ (feeder length) | 3.5 mm ~ 4.5 mm |

FIG.3

ARRAY ANTENNA INCLUDING MULTIPLE POLARIZATION PORTS AND ELECTRONIC DEVICE INCLUDING SAME

CROSS-REFERENCE TO RELATED APPLICATION(S)

This application is based on and claims priority under 35 U.S.C. § 119(a) of a Korean patent application number 10-2021-0108236, filed on Aug. 17, 2021, in the Korean Intellectual Property Office, the disclosure of which is incorporated by reference herein in its entirety.

BACKGROUND

1. Field

The disclosure relates to a wireless communication system. More particularly, the disclosure relates to an array antenna including multiple polarization ports in a wireless communication system, and an electronic device including the same.

2. Description of Related Art

Wireless communication technology has recently been applied to smartphones, tablet medical devices, Internet of Things (IoT) devices, or the like in an increasing number of cases to exchange data with external devices by using an antenna. For such data communication, various polarization characteristics (for example, linear polarization (LP), right hand circular polarization (RHCP), or left hand circular polarization (LHCP)) are required to maximize the channel capacity between devices. There is a problem in that, if multiple radiators are used to implement an antenna having different polarization characteristics in line with such a trend, the opening surface size of the array antenna having various polarizations increases accordingly, thereby making it difficult to apply the same inside a device.

Therefore, there is a need for a technology capable of reducing the size of the array antenna by using a single radiator, and capable of implementing multi-polarization.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an array antenna having improved multi-polarization characteristics, wherein multiple ports are disposed in adjacent positions in order to improve multi-polarization characteristics.

Another aspect of the disclosure it to provide an array antenna wherein a multi-feeding structure is used for a feeding patch, thereby implementing left hand circular polarization (LHCP) and right hand circular polarization (RHCP) characteristics.

Another aspect of the disclosure is to provide an array antenna wherein, for two polarizations perpendicular to each other, a hybrid chip coupler is used, thereby implementing two polarizations perpendicular to each other.

Another aspect of the disclosure is to provide an array antenna wherein multiple ports are disposed in adjacent positions, thereby improving feeding patch and radiating patch gain characteristics.

Additional aspects will be set forth in part in the description which follows and, in part, will be apparent from the description, or may be learned by practice of the presented embodiments.

In accordance with an aspect of the disclosure, an array antenna is provided. The array antenna includes a first substrate having a first thickness and a rectangular shape, a second substrate disposed to be in contact with a bottom surface of the first substrate, and having a second thickness and a rectangular shape, a ground surface shared by the first substrate and the second substrate, and first ports and second ports disposed to penetrate the ground surface.

An array antenna according to various embodiments of the disclosure has ports having different polarizations disposed in adjacent positions such that a polarization diversity gain can be provided through a single radiator.

In addition, an array antenna according to various embodiments of the disclosure employs multi-feeding to a highly-dielectric material and a single radiator such that the antenna size can be reduced, and a polarization diversity gain can also be provided.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which:

FIG. 3 illustrates a table showing a design specification of an array antenna according to an embodiment of the disclosure;

Throughout the drawings, like reference numerals will be understood to refer to like parts, components, and structures.

DETAILED DESCRIPTION

Figure 1:
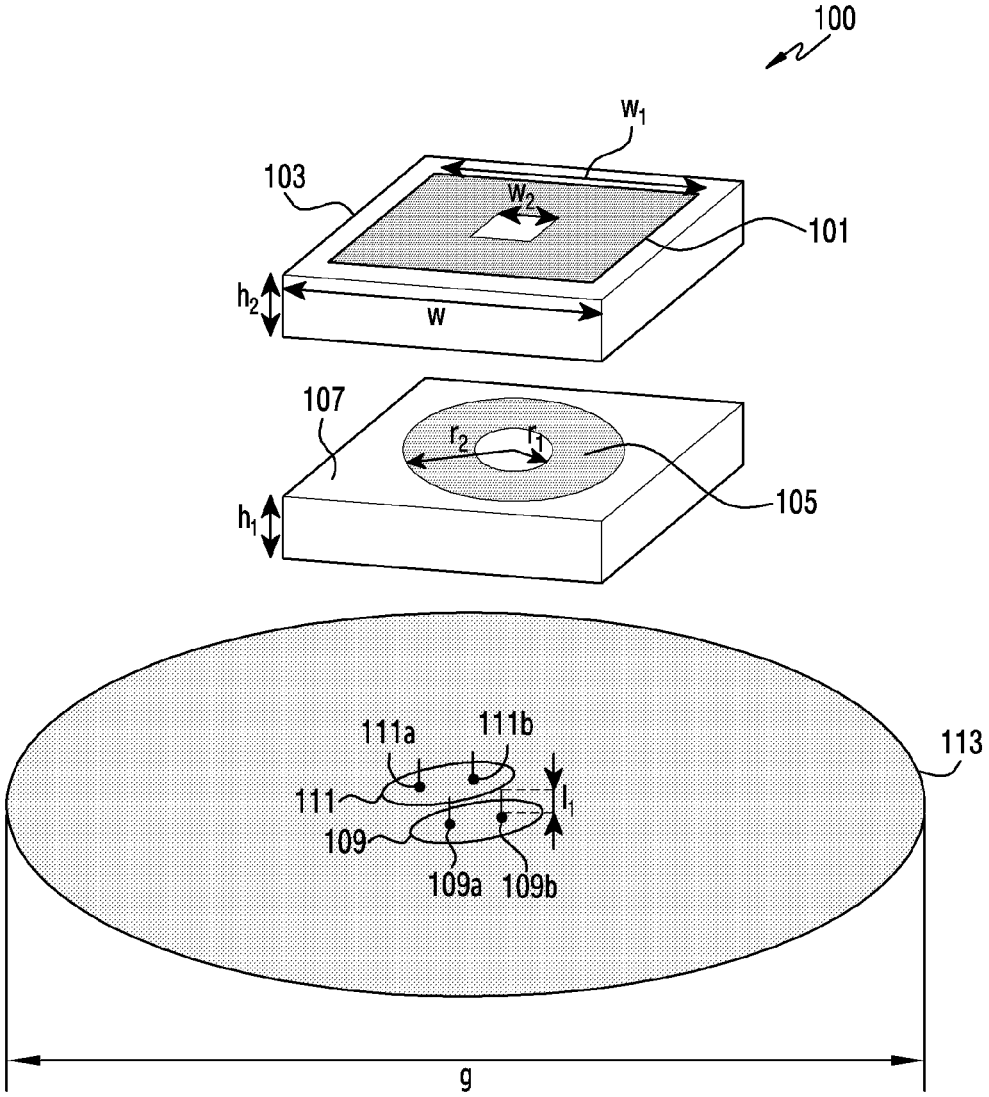
FIG. 1 illustrates a perspective view of an array antenna according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Hereinafter, various embodiments of the disclosure will be described based on an approach of hardware. However, various embodiments of the disclosure include a technology that uses both hardware and software, and thus the various embodiments.

Hereinafter, the disclosure relates to an array antenna for a wireless communication system and an electronic device including the same. Specifically, the disclosure describes a technology for implementing a dual-polarized antenna, that is, a radiating element (e.g., a radiating patch) which provides different types of polarization together. Particularly, since it is expected that equipment having much more antennas will be increasingly used through Massive multiple input multiple output (MIMO) technology, a more efficient antenna design is required in aspects of miniaturization, manufacturing time, and production costs.

Terms used in the following description, terms referring to elements of an electronic device (e.g., "substrate", "print circuit board (PCB)", "flexible PCB (FPCB)", "module", "antenna", "antenna element", "circuit", "processor", "chip", "element", and "device"), terms referring to the shape of a component (e.g., "structure body", "structure", "support unit", "contact unit", "protrusion", and "opening"), terms referring to a connector between structure bodies (e.g., "connector", "contactor", "support", "contact structure", "conductive member", and "assembly"), terms referring to a circuit (e.g., "PCB", "FPCB", "signal line", "feeding line", "data line, "radio frequency (RF) signal line", "antenna line", "RF path", "RF module", and "RF circuit") are examples provided for convenience of the description. Therefore, the disclosure is not limited to the terms described below, and other terms having an equivalent technical meaning may be used. Further, the terms, used below, such as " . . . part", " . . . device", " . . . material", and " . . . body" may imply at least one shape structure or may imply a unit for processing a function.

Further, in the disclosure, in order to determine whether a specific condition is satisfied or fulfilled, the term "more than" or "less than" may be used. However, the term may be merely descriptions for expressing an example, and do not exclude a description of "equal to or more than" or "equal to or less than." A condition described as "equal to or more than" may be replaced with "more than," a condition described as "equal to or less than" may be replaced with "less than," and a condition described as "equal to or more than and less than" may be replaced with "more than and equal to or less than."

Further, the disclosure describes various embodiments by using terms used in some communication standards (e.g., the 3rd Generation Partnership Project (3GPP) and the Institute of Electrical and Electronics Engineers (IEEE)), but the terms are merely examples for description. Various embodiments of the disclosure may also be easily modified and applied to other communication systems.

Recently, in smartphones, tablet medical devices, IoT devices, etc., exchanging data with an external device via an antenna by applying wireless communication technology has increased. In this environment, in order to improve communication performance, the number of antennas (or antenna elements) of equipment for performing wireless communication increases. Further, the number of RF components for processing RF signals received or transmitted through antenna elements increases. Therefore, a spatial gain and cost efficiency, in addition to fulfilling of communication performance, are necessarily required in configuring communication equipment. A dual-polarized antenna using multi-polarization is used to satisfy the requirements. As channel independence is satisfied between signal having different types of polarization, polarization diversity and a signal gain according thereto may increase. That is, for the above-described data communication, various polarization characteristics (linear polarization (LP), right-hand circular polarization (RHCP), and left-hand circular polarization (LHCP)) are required to maximize channel capacity between devices.

In the case of using multiple radiators in order to implement antennas having different polarization characteristics, because the size of an opening surface of an array antenna increases, and thus it is difficult to apply the radiators to the inside of a device. When the interval between antennas is reduced, interference between neighboring antennas increases, thereby degrading cross polarization ratio (CRP) performance. That is, when array antenna elements are forced to be arrayed adjacent to each other, mutual interference occurs between the array antenna elements, and thus a polarization characteristic to be implemented may be reduced. Therefore, cross polarization ratio (CPR) improvement is necessarily required in the dual-polarized antenna. This is because a CPR is proportional to main communication performance such as throughput, a bit error rate (BER) or a polarization diversity (Pol diversity). Accordingly, embodiments of the disclosure provide a technology for miniaturizing an array antenna and obtaining a polarization gain, by implementing, in one radiator, different types of polarization (e.g., left-hand circular polarization (LHCP) and right-hand circular polarization (RHCP).

Embodiments of the disclosure relate to an array antenna. a left-hand circular polarization (LHCP) characteristic and a right-hand circular polarization (RHCP) characteristic may be simultaneously implemented by applying a multi-feeding structure to one radiator (e.g., a patch) or a feeder (e.g., a feeding patch).

Embodiments of the disclosure may use a hybrid chip coupler for two types of polarization orthogonal to each other to improve an impedance matching characteristic and stably provide an axial ratio characteristic of circular polarization (CP). Use of the circular polarization may minimize influence caused by a multipath, thereby improving the performance of the array antenna. Further, the array antenna according to embodiments of the disclosure may increase gain characteristics of both a feeder and a radiator.

In the array antenna according to embodiments of the disclosure, four feeding pins may be disposed in a lower feeder such that orthogonal signals are provided thereto.

Two pins, that is, one pair, may implement LHCP and RHCP characteristics through a hybrid chip coupler. The other pair may implement RHCP or LHCP, so that an LHCP characteristic and an RHCP characteristic may be implemented together in the array antenna through 44 pins.

Through the above-described method, even when one feeding patch is used in an antenna, an axial ratio characteristic may not be reduced, and a circular polarization characteristic may be maintained. Only a high dielectric material and one feeding radiator are used, and thus the array gap of the array antenna can also be minimized. The gap between radiators of the array antenna is reduced, and thus the antenna can be miniaturized. Further, an upper radiating patch is designed, and thus a gain characteristic can be improved by making the radiating pattern be further directed toward the bore-sight than in the case of a single patch.

That is, although embodiments of the disclosure use one radiator, LHCP/RHCP characteristics can be simultaneously implemented, and multi-feeding is provided to the high dielectric material and the single radiator, and thus an antenna can be miniaturized. The disclosure can be applied to various applications. For examples, the disclosure can be applied to a base station antenna using two types of polarization, radio frequency identification (RFID), a receiving IoT device in which polarization is changed by a multipath, a global positioning system (GPS) application.

Hereinafter, examples of the array, structure, performance, and application of a multi-polarized antenna according to embodiments of the disclosure will be described with reference to FIGS. 1 to 6.

FIG. 1 illustrates a perspective view of an array antenna according to an embodiment of the disclosure.

Referring to FIG. 1, an array antenna 100 may include a first substrate 103, a second substrate 107, a ground surface 113, first ports 111, and second ports 109.

The first substrate 103 implies a substrate on which a radiator 101 is mounted. According to an embodiment, the first substrate 103 may be rectangular parallelepiped having a predetermined width (W) and a predetermined height ($h_2$). According to an embodiment, the first substrate 103 may be formed of a ceramic.

The radiator 101 may be disposed on one surface of the first substrate 103. According to an embodiment, the radiator 101 may be placed to be in contact with the top surface of the first substrate 103. According to an embodiment, the radiator 101 may be formed in a patch type. That is, the radiator 101 may be a radiating patch. Hereinafter, a radiating patch in the disclosure may be described while being referred to as a first patch. For example, the radiator 101 may have a rectangular shape having a predetermined width ($W_1$). According to an embodiment, the predetermined width ($W_1$) of the radiator 101 may be smaller than the predetermined width (W) of the first substrate 103. According to an embodiment, the first substrate 103 may be in contact with the radiator 101 such that the center of the first substrate 103 is aligned with the center of the radiator 101. According to an embodiment, the radiator 101 may include a hole in which a predetermined region in a patch surface is empty. For example, the radiator 101 may include a rectangular hole which is formed at the center of the radiator 101 and has a predetermined width ($W_2$).

Referring to FIG. 1, the second substrate 107 implies a substrate on which a feeder 105 is placed. According to an embodiment, the second substrate 107 may be a rectangular parallelepiped having a predetermined height ($h_1$). According to an embodiment, the second substrate 107 may be formed of a ceramic.

The feeder 105 may be disposed on one surface of the second substrate 107. According to an embodiment, the feeder 105 may be placed while being in contact with the top surface of the second substrate 107. According to an embodiment, the feeder 105 may be formed in a patch type. That is, the feeder 105 may be called a feeding patch. Hereinafter, a feeding patch in the disclosure may be referred to and described as a second patch. For example, in relation to the feeder 105, the second patch (i.e., the feeder 105) may be a circular patch having a predetermined radius ($r_2$). According to an embodiment, the feeder 105 may include a hole in which a predetermined region in a patch surface is empty. For example, the feeder 105 may include a circular hole which is formed at the center of the feeder 105 and has a predetermined radius ($r_1$). According to an embodiment, the predetermined radius ($r_1$) of the hole may be smaller than the predetermined radius ($r_2$) of the feeder 105. According to an embodiment, the second substrate 107 may be in contact with the feeder 105 such that the center of the second substrate 107 is aligned with the center of the feeder 105.

Referring to FIG. 1, the ground surface 113 may imply a substrate for forming a ground for the radiator 101 and the feeder 105. In the ground surface 113, a ground shared by the first substrate 103 and the second substrate 107 may be formed. According to an embodiment, the ground surface 113 may be disposed while being in contact with the bottom of the second substrate 107. According to an embodiment, the ground surface 113 may have a circular shape having a predetermined diameter (g). In an embodiment, the ground surface 113 may be a PCB.

According to an embodiment, the ground surface 113 may include the first ports 111 and the second ports 109, which penetrate the ground surface 113. The first ports 111 may include a (1-1)th port 111*a* and a (1-2)th port 111*b*. The second ports 109 may include a (2-1)th port 109*a* and a (2-2)th port 109*b*. The first ports 111 may be related to first polarization, and the second ports 109 may be related to second polarization. According to an embodiment, the first polarization and the second polarization may be configured to correspond to each other. For example, according to an embodiment, the first ports 111 may be left-hand circular polarization (LHCP) ports. According to an embodiment, the second ports 109 may be right-hand circular polarization (RHCP) ports.

According to an embodiment, the RHCP feeding may be implemented by applying phase differences of 0° and 90° to two feeding ports (e.g., the (1-1)th port 111*a* and the (1-2)th port 111*b*). The LHCP ports may be implemented by applying phase differences of 0° and −90° to two remaining feeding ports (e.g., the (2-1)th port 109*a* and the (2-2)th port 109*b*) among four feeding ports.

According to an embodiment, the first ports 111 and the second ports 109 may be disposed to be symmetric to each other with the center of the ground surface.

According to an embodiment, the (1-1)th port 111*a* and the (2-2)th port 109*b* may be disposed to be symmetric to each other with respect to the center of the ground surface.

According to an embodiment, the (1-2)th port 111*b* and the (2-1)th port 109*a* may be disposed to be symmetric to each other with respect to the center of the ground surface.

According to an embodiment, the (1-1)th port 111*a*, the (1-2)th port 111*b*, the (2-1)th port 109*a*, and the (2-2)th port 109*b* may have a predetermined height ($l_1$).

Figure 2:
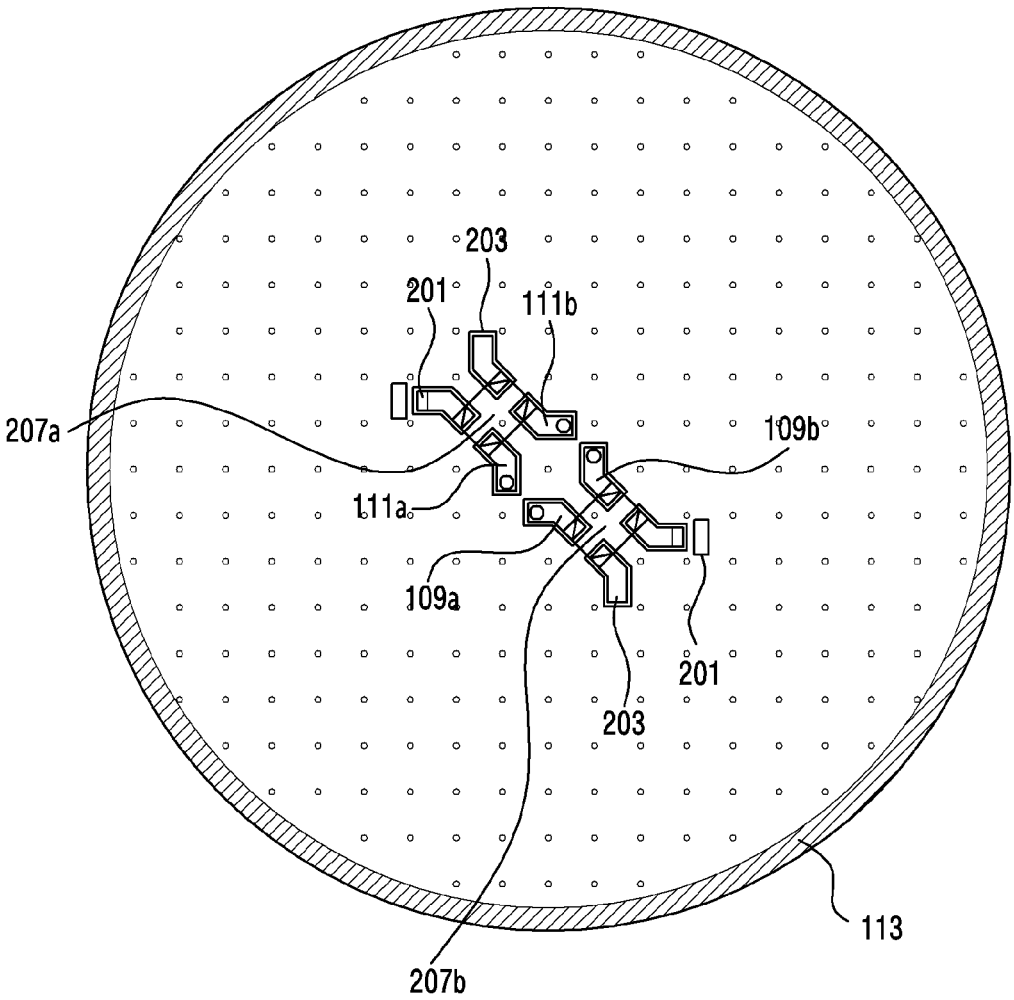
FIG. 2 illustrates one surface of an array antenna according to an embodiment of the disclosure.

FIG. 2 illustrates one surface of an array antenna according to an embodiment of the disclosure. A cross section may correspond to a direction in which the ground surface of the array antenna in FIG. 1 is seen. A hybrid coupler (e.g., a first hybrid chip coupler 207*a* and a second hybrid chip coupler 207*b*) implies a circuit which divides an input signal into two output paths and allows the two output paths to have a phase difference therebetween. The hybrid coupler has a good possibility of application due to a unique phase difference between the two outputs, and is very widely applied an antenna system, a high-output amplifier, a linear system, etc. When all ports are matched according to a basic operation of the hybrid coupler, a signal applied to an input port may be bisected by two output ports while having a phase difference of 90 degrees.

Referring to FIG. 2, an array antenna 100 may include a first hybrid chip coupler 207*a*, a second hybrid chip coupler 207*b*, a port (ports) 203 for connecting a resistor, a port (ports) 201 for applying a source, and the first ports 111 and the second ports 109, which penetrate the ground surface 113.

According to an embodiment, the (1-1)th port 111*a* and the (1-2)th port 111*b*, included in the first ports 111, and the (2-1)th port 109*a* and the (2-2)th port 109*b*, included in the second ports 109, may be disposed as in FIG. 2 while penetrating the ground surface 113.

According to an embodiment, port 201 for applying a source, port 203 for connecting a resistor, the (1-1)th port 111*a*, and the (1-2)th port 111*b* may be connected to the first hybrid chip coupler 207*a*.

According to an embodiment, the source may be applied, using a coaxial cable, to the port (ports) 201 for applying the source, connected to the first hybrid chip coupler 207*a*.

According to an embodiment, a resistor having a predetermine resistance may be connected to port 203 for connecting the resistor, connected to the first hybrid chip coupler 207*a*. According to an embodiment, the predetermined resistance may be about 50 ohms.

According to an embodiment, signals having a phase difference of 90 degrees therebetween may be fed to the (1-1)th port 111*a* and the (1-2)th port 111*b*, respectively. For example, the (1-1)th port 111*a* may be fed with a signal having a lead of 90 degrees over a signal fed to the (1-2)th port 111*b*.

According to an embodiment, the (1-1)th port 111*a* and the (1-2)th port 111*b* may be used as RHCP feeding ports by using the first hybrid chip coupler 207*a*.

According to an embodiment, port 201 for applying a source, the port for connecting a resistor, the (2-1)th port 109*a*, and the (2-2)th port 109*b* may be connected to the second hybrid chip coupler 207*b*.

According to an embodiment, the source may be applied, using a coaxial cable, to the port (ports) 201 for applying the source, connected to the second hybrid chip coupler 207*b*.

According to an embodiment, a resistor having a predetermine resistance may be connected to port 203 for connecting a resistor, connected to the second hybrid chip coupler 207*b*. According to an embodiment, the predetermined resistance may be about 50 ohms.

According to an embodiment, signals having a phase difference of 90 degrees therebetween may be fed to the (2-1)th port 109*a* and the (2-2)th port 109*b*, respectively. For example, the (2-1)th port 109*a* may be fed with a signal lagging 90 degrees behind the (2-2)th port 109*b*.

According to an embodiment, the (2-1)th port 109*a* and the (2-2)th port 109*b* may be used as LHCP feeding ports by using the second hybrid chip coupler 207*b*.

According to an embodiment, the first ports 111 and the second ports 109 may be arranged to be symmetric to each other with respect to the center of the ground surface.

According to an embodiment, the (1-1)th port 111*a* and the (2-2)th port 109*b* may be arranged to be symmetric to each other with respect to the center of the ground surface.

According to an embodiment, the (1-2)th port 111*b* and the (2-1)th port 109*a* may be arranged to be symmetric to each other with respect to the center of the ground surface.

In an embodiment, the ground surface 113 may be a PCB.

RHCP or an LHCP may be simultaneously fed using the ground surface 113, the first hybrid chip coupler 207*a*, and the second hybrid chip coupler 207*b* according to embodiments of the disclosure. Through simultaneous feeding, an operation may be performed without any problem with an axial ratio (AR) characteristic and a gain characteristic. By applying an operation principle of the first and second hybrid chip couplers 207*a* and 207*b* to a source signal, two feeding ports (the (1-1)th port 111*a* and the (1-2)th port 111*b*) may be provided with feeding having phase differences of 0° and 90°, respectively. Further, two remaining feeding ports (the (2-1)th port 109*a* and the (2-2)th port 109*b*) may be provided with feeding having phase differences of 0° and −90°, respectively. Therefore, the RHCP port may be implemented through the first ports 111, and the LHCP port may be implemented through the second ports 109.

FIG. 3 illustrates a table showing a design specification of an array antenna according to an embodiment of the disclosure. It is not construed that the values illustrated in FIG. 3 limit embodiments of the disclosure. Further, implementation according to a range having an error range of +5% to −5% within the range illustrated in FIG. 3 may be considered to be an embodiment of the disclosure.

Referring to FIG. 3, the length ($W_1$) of an outer side of a radiator 101 may be larger than an outer diameter (i.e., $2*r_2$) of a second patch (i.e., a feeder 105).

According to an embodiment, the length ($W_2$) of a side of the inner hole of the radiator 101 may be larger than the diameter (($2*r_1$) of the inner hole of the second patch. For example, $W_2$ may have a length of 0.5 to 2.2 mm. Further, $r_1$ may have a length of about 0.5 to 2 mm.

According to an embodiment, $h_1$ and $h_2$, which are the heights of the first substrate 103 and the second substrate 107, respectively, may be different from each other. For example, each of $h_1$ and $h_2$ may have a length of about 3.5 to 4.5 mm. Further, $h_2$ may have a length of about 3.5 to 4.5 mm.

According to an embodiment, the diameter (g) of the ground surface 113 may be far larger than the length ($W_2$) of an outer side of each of the first substrate 103 and the second substrate 107. For example, the diameter (g) of the ground surface 113 may be larger than about 80 mm.

According to an embodiment, the (1-1)th port 111*a*, the (1-2)th port 111*b*, the (2-1)th port 109*a*, and the (2-2)th port 109*b* may have the same length or different lengths. For example, the (1-1)th port 111*a*, the (1-2)th port 111*b*, the (2-1)th port 109*a*, and the (2-2)th port 109*b* may have lengths of 3.5 to 4.5 mm.

According to an embodiment, the first substrate 103 and the second substrate 107 may be formed of a ceramic material. For example, a relative dielectric constant (er) may have a value of about 20, and loss tangent may have a value of about 0.0023.

According to an embodiment, the radiator 101 and the second patch (i.e., the feeder 105) may be formed of a copper material. For example, the conductivity of the radiator 101 and the second patch may be about $5.8\times10^7$ mS/m.

Figure 4:
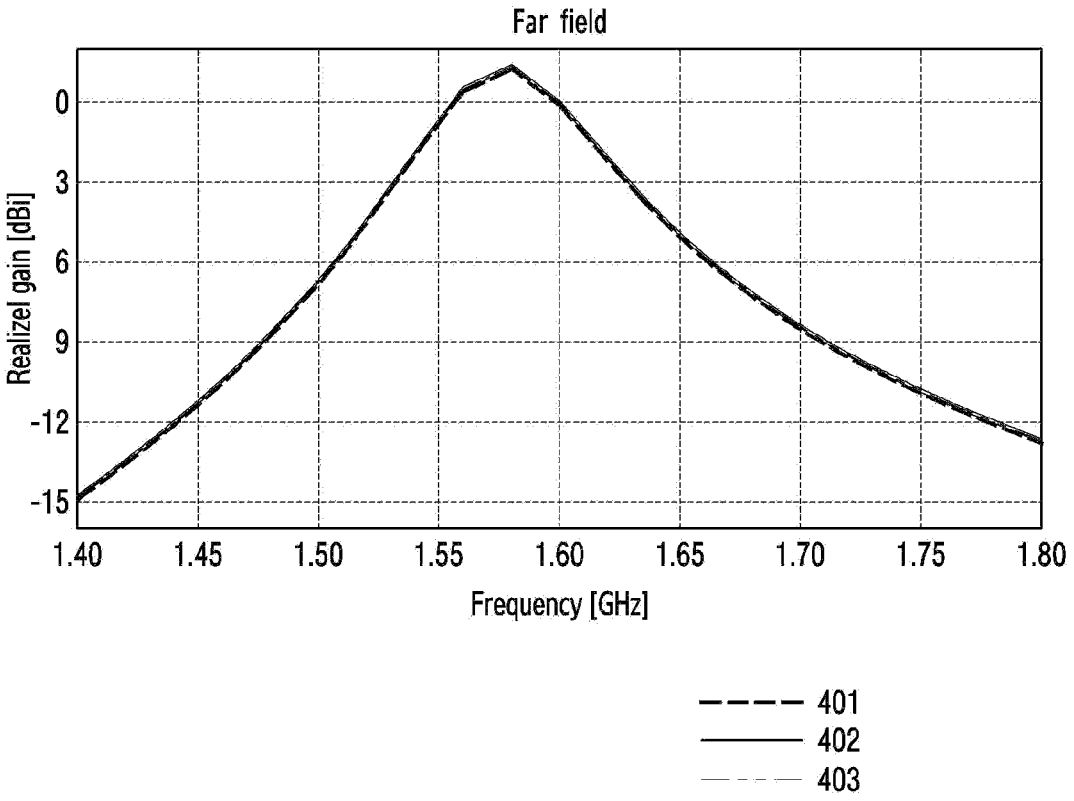
FIG. 4 illustrates a graph showing a gain characteristic of an array antenna according to an embodiment of the disclosure.

FIG. 4 illustrates a graph showing a gain characteristic of an array antenna according to an embodiment of the disclosure.

Referring to FIG. 4, the graph shows a relationship between a frequency and a gain. The horizontal axis of the graph shows a frequency (unit: gigahertz (GHz)), and the vertical axis thereof shows a gain (unit: decibel isotropic (dbi)). A dotted line 401 shows a bore-sight gain when the first ports 111 correspond to LHCP. A solid line 402 shows a bore-sight gain when the second ports 109 correspond to RHCP. A chain double-dashed line 403 shows the total bore-sight gain of the first ports and the second ports. That is, it may be determined that an LHCP gain of the dotted line 401 and an RHCP gain of the solid line 402 are equal to a total bore-sight gain of the double-dashed line 403.

Figure 5:
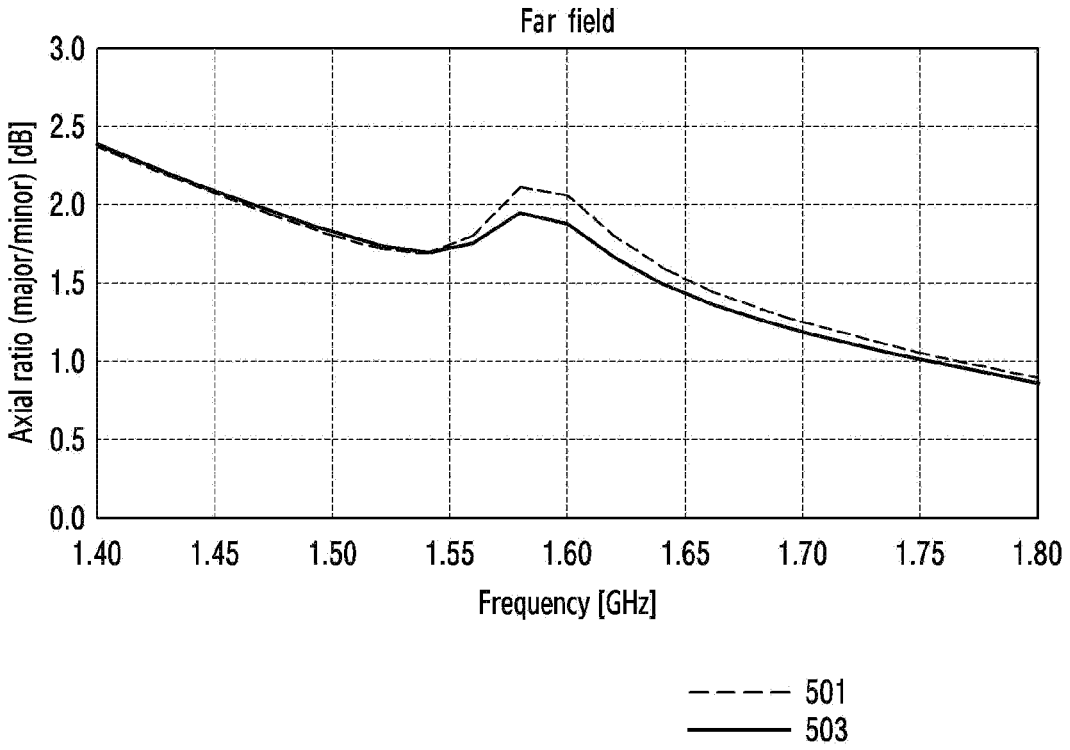
FIG. 5 illustrates a graph showing an axial ratio characteristic of an array antenna according to an embodiment of the disclosure.

FIG. 5 illustrates a graph showing an axial ratio characteristic of an array antenna according to an embodiment of the disclosure. The axial ratio characteristic, which a polarization axis ratio, implies the ratio of a minor axis to a major axis. If the axial ratio is 1, the axial ratio represents circular polarization, and if an axial ratio is greater than 1, the axial ratio implies elliptical polarization (or linear polarization).

Referring to FIG. 5, the graph shows a relationship between a frequency and an axial ratio characteristic. The horizontal axis of the graph shows a frequency (unit: gigahertz (GHz)), and the vertical axis thereof shows an axial ratio (unit: decibel (db)). A dotted line 501 shows an axial ratio in the case of RHCP, and a solid line 503 shows an axial ratio in the case of LHCP. That is, when the shape of the array antenna 100 of the disclosure is used, LHCP and RHCP may be simultaneously fed and implemented using one radiator, and it may be determined that circular polarization, not elliptical polarization, is implemented when the axial ratio characteristic is below 3 dB.

Figure 6:
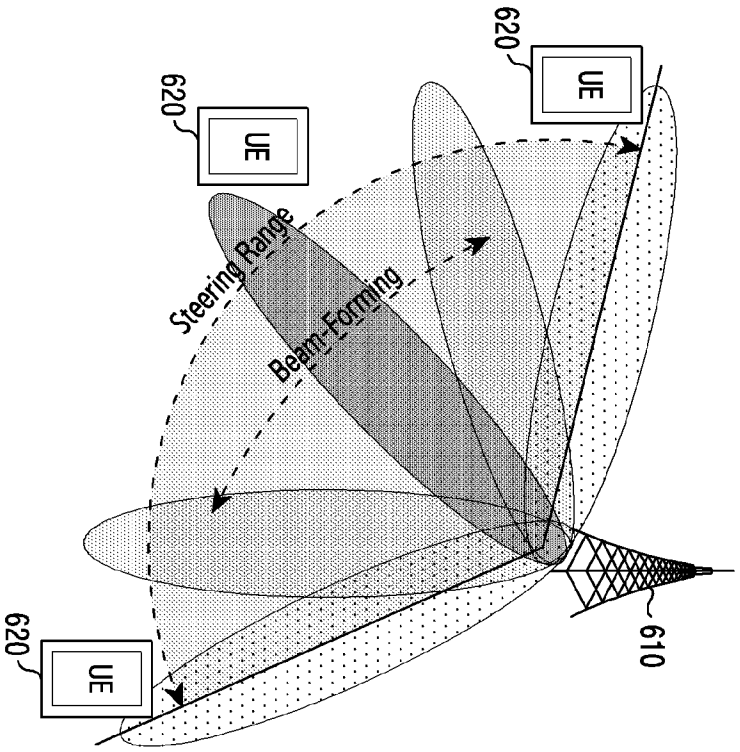
FIG. 6 illustrates an example of an electronic device including an array antenna according to an embodiment of the disclosure.

FIG. 6 illustrates an example of an electronic device including an array antenna according to an embodiment of the disclosure. A base station and a terminal are provided as examples of an electronic device using an array antenna in a wireless communication system.

Referring to FIG. 6, a base station 610 is a network infrastructure for providing wireless access to a terminal 620. The base station 610 has coverage that is defined as a predetermined graphical region on the basis of the distance to which a signal can be transmitted. The base station 610 may be called, in addition to "base station", "access point (AP)", "eNodeB (eNB)", "5th generation node (5G node)", "5G NodeB (NB)", "wireless point", "transmission/reception point (TRP)", "access unit", "distributed unit (DU)", "transmission/reception point (TRP)", "radio unit (RU)", "remote radio head (RRH)", or other terms having a technical meaning identical thereto. The base station 610 may transmit a downlink signal or may receive an uplink signal.

The terminal 620 is a device used by a user, and communicates with the base station 610 through a wireless channel. In some cases, the terminal 620 may operate without the user's involvement. That is, the terminal 620 may be a device for performing machine type communication (MTC), and may not be carried by the user. The terminal 620 may be called, in addition to "terminal" "user equipment (UE)", "mobile station", "subscriber station", "customer premises equipment (CPE)" "remote terminal", "wireless terminal", "electronic device", "vehicle terminal", "user device", or other terms having a technical meaning identical thereto. According to an embodiment, the embodiments of the disclosure may also be applied to vehicle or aerial equipment used for a radar system.

Figure 7:
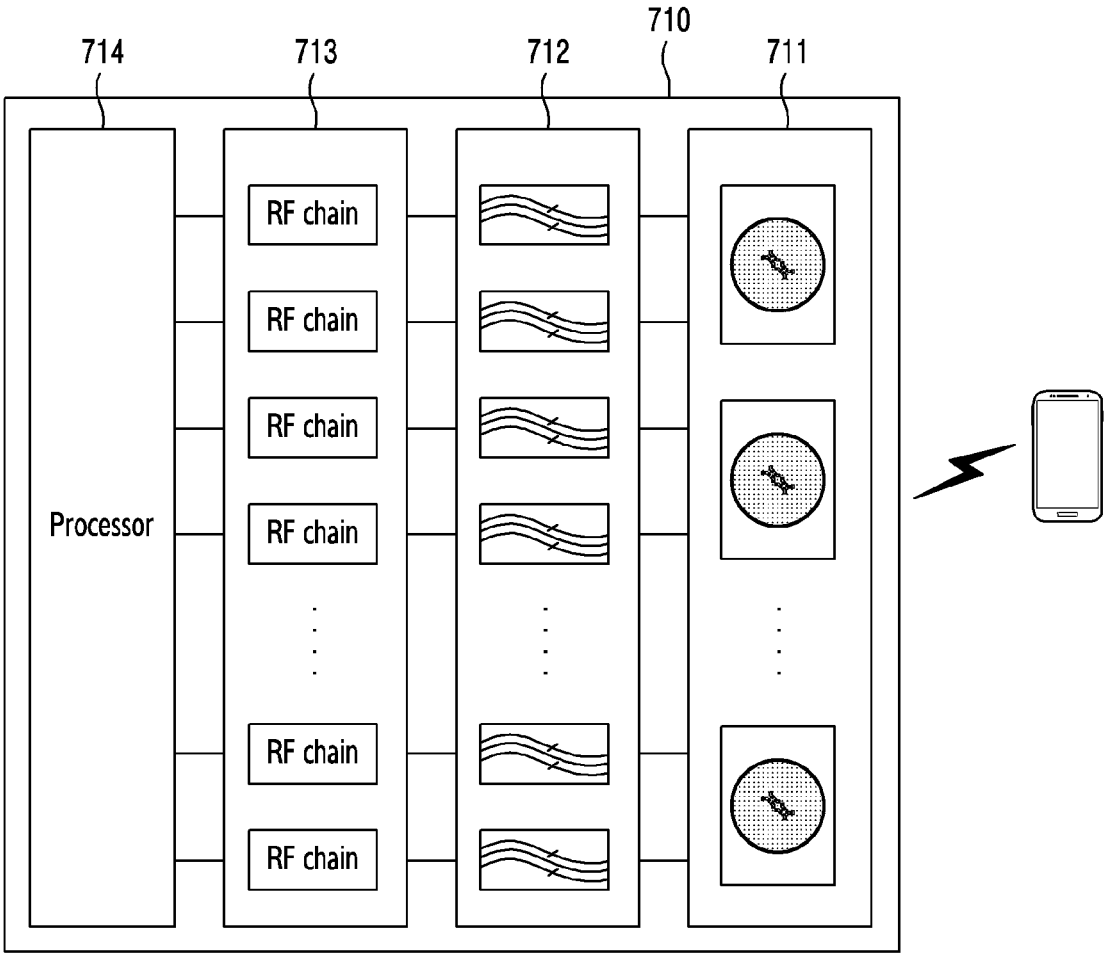
FIG. 7 illustrates a functional configuration of an electronic device according to an embodiment of the disclosure.

FIG. 7 illustrates a functional configuration of an electronic device according to an embodiment of the disclosure. An electronic device may be one of a base station or a terminal. Embodiments of the disclosure include not only the antenna structure described through FIGS. 1 and 2 but also an electronic device including the same.

Referring to FIG. 7, a functional configuration of an electronic device 710 is illustrated. The electronic device 710 may include an antenna unit 711, a filter unit 712, a radio frequency (RF) processor 713, and a controller (i.e., a processor) 714.

The antenna unit 711 may include multiple antennas. The antennas perform a function of transmitting or receiving a signal through a wireless channel. Each of the antennas may include a conductor disposed on a substrate (e.g., the PCB) (e.g., the first substrate) or a radiator formed as a conductive pattern. The antennas may radiate upconverted signals on a wireless channel or may acquire signals radiated by another device. Each antenna may be called an antenna element or an antenna device. In some embodiments, the antenna unit 711 may include an antenna array in which multiple antenna elements form an array. The antenna unit 711 may be electrically connected to the filter unit 712 through RF signal lines. The antenna unit 711 may be mounted on a PCB including multiple antenna elements. The PCB may include multiple RF signal lines for connecting each antenna element to a filter of the filter unit 712. The RF signal lines may be called a feeding network. The antenna unit 711 may provide a received signal to the filter unit 712, or may radiate a signal provided from the filter unit 712 into the air.

The antenna unit 711 according to various embodiments may include at least one antenna module in which the radiator mounted on the first substrate, the feeder mounted on the second substrate, and the ground surface, illustrated in FIG. 1, are stacked. The antenna module may include one radiator structure corresponding to different types of polarization. According to an embodiment, a radiator in which different types of polarization, LHCP and RHCP, are implemented together may be included. A radiator corresponding to an antenna element may be connected to multiple ports through a hybrid coupler and a feeding line. One pair of ports may be configured to form one type of polarization. The antenna unit 711 may be electrically connected to the filter unit 712, the RF processor 713, and the controller 714, which are described below. That is, signals applied to the ports may be received from the filter unit 712, the RF processor 713, and the controller 714.

The filter unit 712 may perform filtering in order to transfer a signal of a desired frequency. The filter unit 712 may form resonance so as to perform a function for selectively identifying a frequency. In some embodiments, the filter unit 712 may form resonance through a cavity structurally including a dielectric material. Further, in some embodiments, the filter unit 712 may form resonance through elements for forming inductance or capacitance. Further, in some embodiments, the filter unit 712 may include an elastic filter such as a bulk acoustic wave (BAW) filter or a surface acoustic wave (SAW) filter. The filter unit 712 may include at least one among a band pass filter, a low pass filter, a high pass filter, or a band reject filter. That is, the filter unit 712 may include RF circuits for obtaining a signal of a frequency band for transmission or a frequency band for reception. The filter unit 712 according to various embodiments may electrically connect the antenna unit 711 to the RF processor 713.

The RF processor 713 may include multiple RF paths. An RF path may be a unit of a path through which a signal received through an antenna or a signal radiated through the antenna passes. At least one RF path may be called an RF chain. An RF chain may include multiple RF elements. The RF elements may include an amplifier, a mixer, an oscillator, a digital-to-analog converter (DAC), an analog-to-digital converter (ADC), etc. For example, the RF processor 713 may include: an up-converter for up-converting a digital transmission signal of a baseband to a transmission frequency; and a DAC for converting the up-converted digital transmission signal to an analog RF transmission signal. The up-converter and the DAC form a part of a transmission path. The transmission path may further include a power amplifier (PA) or a coupler (or a combiner). Further, for example, the RF processor 713 may include: an ADC for converting an analog RF reception signal to a digital reception signal; and a down-converter for converting the digital reception signal to a digital reception of a baseband. The ADC and the down-converter form a part of a reception path. The reception path may further include a low-power amplifier (low-noise amplifier (LNA)) or a coupler (or a divider). RF components of the RF processor may be implemented on a PCB. The electronic device 710 may include a structure in which the antenna unit 711, the filter unit 712, and the RF processor 713 are stacked in the order of the antenna unit 711-the filter unit 712-the RF processor 713. The antennas and the RF components of the RF processor may be implemented on a PCB, and the filters may be repeatedly fastened to each other between a PCB and a PCB to form multiple layers.

The controller 714 may control overall operations of the electronic device 710. The controller 714 may include various modules for performing communication. The controller 714 may include at least one processor such as a modem. The controller 714 may include a module for digital signal processing. For example, the controller 714 may include a modem. At the time of data transmission, the controller 714 generates multiple symbols by encoding and modulating a transmission bit string. Further, For example, at the time of data reception, the controller 714 reconstructs a reception bit string by demodulating and decoding a baseband signal. The controller 714 may perform functions of protocol stack required by communication standards.

In the case of a 5G base station antenna compared with a 4G base station antenna, polarization performance is more important due to a narrow interval between antennas. In the case of the 4G base station for providing a service by using wide beams, as the interval between antennas become wider, the degree of space separation increases, and thus communication is improved. However, in the 5G base station for providing a service by using a beam having a narrow beam width and a high power-density, the antenna interval of an array antenna should be narrowed in order to widen a beamforming region. Thus, compared with a 4G base station (e.g., an eNB of long term evolution (LTE)) antenna, 5G base station (e.g., next generation node B (gNB) or next generation-random access node (NG-RAN) node of 5G new radio (NR)) antennas have a narrow antenna interval, and thus interference between antennas increases. Therefore, a technology for achieving miniaturization thereof and providing a polarization gain is necessarily required.

In according to various embodiments of the disclosure, an array antenna may include: a first substrate having a first thickness and a rectangular shape; a second substrate disposed to be in contact with the bottom surface of the first substrate and having a second thickness and a rectangular shape; a ground surface shared by the first substrate and the second substrate; and first ports and second ports disposed to penetrate the ground surface.

In an embodiment, the first substrate may include a first patch which is in contact with the top of the first substrate.

In an embodiment, the second substrate may include a second patch which is in contact with the top of the second substrate.

In an embodiment, the first patch may be rectangular.

In an embodiment, the second patch may be circular.

In an embodiment, the first ports may be left-hand circular polarization (LHCP) ports.

In an embodiment, the second ports may be right-hand circular polarization (RHCP) ports.

In an embodiment, the first ports may include a (1-1)th port and a (1-2)th port, and the second ports may include a (2-1)th port and a (2-2)th port.

In an embodiment, the (1-1)th port, the (1-2)th port, the (2-1)th port, and the (2-2)th port may be symmetric to each other with respect to the centers of the first substrate and the second substrate.

In an embodiment, the first patch may include a rectangular hole having a predetermined width with respect to the center of the first patch.

In an embodiment, the second patch may include a circular hole having a predetermined radius with respect to the center of the second patch.

In an embodiment, the ground surface may have a circular shape having a predetermined diameter.

In an embodiment, the first substrate may be a ceramic substrate.

In an embodiment, the second substrate may be a ceramic substrate.

In an embodiment, the ground surface may be a printed circuit board (PCB).

In an embodiment, a first hybrid chip coupler configured to form first polarization may be included in the bottom surface of the ground surface.

In an embodiment, a second hybrid chip coupler configured to form second polarization may be included in the bottom surface of the ground surface.

In an embodiment, a port for application of a source may be included in the bottom surface of the ground surface.

In an embodiment, the source may be applied to the port for the application of the source by using a coaxial cable.

In an embodiment, the first hybrid chip coupler may include a port for connection of a resistor.

In an embodiment, the second hybrid chip coupler may include a port for connection of a resistor.

In an embodiment, the (1-1)th port and the (1-2)th port may be connected to the first hybrid chip coupler.

In an embodiment, the (2-1)th port and the (2-2)th port may be connected to the second hybrid chip coupler.

In an embodiment, signals having a phase difference of 90 degrees therebetween may be applied to the (1-1)th port and the (1-2)th port.

In an embodiment, signals having a phase difference of 90 degrees therebetween may be applied to the (2-1)th port and the (2-2)th port.

Terms used to refer to elements of a device in the following description, and the like are examples provided for convenience of the description. Therefore, the disclosure is not limited to the terms described below, and other terms having equivalent technical meanings may be used.

Further, in the disclosure, in order to determine whether a specific condition is satisfied or fulfilled, the term "more than" or "less than" has been used. However, the term may be merely descriptions for expressing an example, and do not exclude a description of "equal to or more than" or "equal to or less than". A condition described as "equal to or more than" may be replaced with "more than", a condition described as "equal to or less than" may be replaced with "less than", and a condition described as "equal to or more than and less than" may be replaced with "more than and equal to or less than."

A method according to an embodiment may be implemented in the form of a program command capable of being carried out through various computer means, and may be recorded in a computer-readable medium. The computer-readable medium may include a program command, a data file, a data structure, etc., taken alone or in combination. A program command recorded in the medium may be specially designed and configured for an embodiment, or may be well-known to and used by those skilled in the computer software art. Examples of a computer-readable recording media include: magnetic media such as hard disks, floppy disks and magnetic tape; optical recording media such as CD-ROM and DVD; magneto-optical media such as floptical disks; and hardware devices specifically configured to store and execute program commands, such as ROM, RAM, and flash memory. Examples of the program commands include not only machine codes generated by a compiler, but also high-level language codes that can be executed by a computer using an interpreter or the like. The hardware devices may be configured to operate as one or more software modules in order to execute operations in an embodiment, and vice versa.

As described, the limited embodiments have been described with reference to the accompanying drawings. However, those skilled in the art can make various modifications and variations from the above description. For example, an appropriate result can be achieved even when the described techniques is performed in the order different from the described method and/or even when elements, such as the described system, structure, device, and circuit, etc. may be coupled or combined in a form different from the described method, or are replaced or substituted with other elements or equivalents.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An array antenna comprising:

a first substrate having a rectangular shape comprising a first thickness;

a second substrate contacting a bottom surface of the first substrate and having a rectangular shape comprising a second thickness;

a ground surface shared by the first substrate and the second substrate;

first ports and second ports disposed to penetrate the ground surface;

a first hybrid chip coupler configured to form a left-hand circular polarization (LHCP), wherein the first hybrid chip coupler is disposed in a bottom surface of the ground surface; and a second hybrid chip coupler configured to form a right-hand circular polarization (RHCP), wherein the second hybrid chip coupler is disposed in the bottom surface of the ground surface, wherein the first ports are used as LHCP ports based on the first hybrid chip coupler, and wherein the second ports are used as RHCP ports based on the second hybrid chip coupler.

2. The array antenna of claim 1, wherein the first substrate comprises a first patch contacting a top surface of the first substrate.

3. The array antenna of claim 1, wherein the second substrate comprises a second patch contacting a top surface of the second substrate.

4. The array antenna of claim 2, wherein the first patch is rectangular.

5. The array antenna of claim 3, wherein the second patch is circular.

6. The array antenna of claim 1, wherein the first ports comprise a (1-1)th port and a (1-2)th port, and wherein the second ports comprise a (2-1)th port and a (2-2)th port.

7. The array antenna of claim 6, wherein the (1-1)th port, the (1-2)th port, the (2-1)th port, and the (2-2)th port are symmetric to each other with respect to centers of the first substrate and the second substrate.

8. The array antenna of claim 2, wherein the first patch comprises a rectangular hole having a predetermined width with respect to a center of the first patch.

9. The array antenna of claim 3, wherein the second patch comprises a circular hole having a predetermined radius with respect to a center of the second patch.

10. The array antenna of claim 1, wherein the ground surface has a circular shape having a predetermined diameter.

11. The array antenna of claim 1, wherein the first substrate comprises a ceramic substrate.

12. The array antenna of claim 1, wherein the second substrate comprises a ceramic substrate.

13. The array antenna of claim 1, wherein the ground surface comprises a printed circuit board (PCB).

14. The array antenna of claim 1, further comprising:

a port configured to apply a source, wherein the port is disposed in a bottom surface of the ground surface.

15. The array antenna of claim 14, wherein the port is further configured to use a coaxial cable to apply the source.

16. The array antenna of claim 1, wherein the first hybrid chip coupler comprises a port connecting a resistor.

* * * * *